United States Patent [19]

Capp et al.

[11] 4,122,897

[45] Oct. 31, 1978

[54] IN SITU GASIFICATION PROCESS FOR PRODUCING PRODUCT GAS ENRICHED IN CARBON MONOXIDE AND HYDROGEN

[75] Inventors: John P. Capp; Larry A. Bissett, both of Morgantown, W. Va.

[73] Assignee: The United States of America as represented by the United States Department of Energy, Washington, D.C.

[21] Appl. No.: 865,156

[22] Filed: Dec. 28, 1977

[51] Int. Cl.[2] ..... E21B 43/24

[52] U.S. Cl. ..... 166/256; 48/DIG. 6; 166/50; 166/251; 166/259

[58] Field of Search ..... 166/251, 256, 257, 259, 166/263, 50; 299/2; 48/DIG. 6

[56] References Cited

U.S. PATENT DOCUMENTS

| | | | |
|---|---|---|---|
| 2,786,660 | 3/1957 | Alleman | 166/256 X |
| 2,973,811 | 3/1961 | Rogers | 166/251 |
| 3,604,507 | 9/1971 | Thomas | 166/259 |
| 3,770,398 | 11/1973 | Abraham et al. | 166/256 X |
| 3,997,005 | 12/1976 | Komar | 166/251 |
| 4,024,914 | 5/1977 | Kreinin | 166/251 |
| 4,062,404 | 12/1977 | Pasiniet al. | 166/259 |
| 4,069,867 | 1/1978 | Bisset | 166/256 |

FOREIGN PATENT DOCUMENTS

| | | | |
|---|---|---|---|
| 481,151 | 2/1952 | Canada | 166/256 |
| 762,484 | 11/1956 | United Kingdom | 299/2 |

OTHER PUBLICATIONS

Chekin et al., "Underground Gasification of Coals," *The Colliery Guardian,* vol. CLII, No. 3939, Jun. 26, 1936, pp. 1193–1196.

*Primary Examiner*—Stephen J. Novosad
*Assistant Examiner*—George A. Suchfield
*Attorney, Agent, or Firm*—Dean E. Carlson; Stephen D. Hamel; Earl L. Larcher

[57] ABSTRACT

The present invention is directed to an in situ coal gasification process wherein the combustion zone within the underground coal bed is fed with air at increasing pressure to increase pressure and temperature in the combustion zone for forcing product gases and water naturally present in the coal bed into the coal bed surrounding the combustion zone. No outflow of combustion products occurs during the build-up of pressure and temperature in the combustion zone. After the coal bed reaches a temperature of about 2000° F and a pressure in the range of about 100–200 psi above pore pressure the airflow is terminated and the outflow of the combustion products from the combustion zone is initiated. The $CO_2$ containing gaseous products and the water bleed back into the combustion zone to react endothermically with the hot carbon of the combustion zone to produce a burnable gas with a relatively high hydrogen and carbon monoxide content. About 11 to 29 percent of the gas recovered from the combustion zone is carbon monoxide which is considerably better than the 4 to 10 percent carbon monoxide obtained by employing previously known coal gasification techniques.

7 Claims, 4 Drawing Figures

Figure 1:
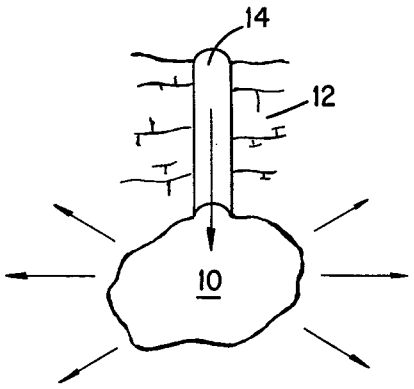

IN SITU GASIFICATION PROCESS FOR PRODUCING PRODUCT GAS ENRICHED IN CARBON MONOXIDE AND HYDROGEN

The present invention relates generally to a method for in situ gasification of subterranean coal beds and more particularly to such a method wherein product gases are provided with a concentration of carbon monoxide and hydrogen greater than heretofore obtainable.

Recovery of carbon-containing gases from underground strata containing coal by employing in situ combustion processes is becoming of increased importance due to the energy requirements of the world. The in situ combustion process is initiated in the coal bed and the resulting combustion zone is caused to expand through the strata in either reverse or forward burn configuration. The heat of combustion gasifies the coal to provide recoverable gaseous products which contain considerable energy values. Many variables are associated with the in situ combustion process which determine operating parameters. For example, in a conventional forward or reverse burn in situ combustion process the underground strata or coal bed is penetrated by a borehole or several boreholes at spaced-apart locations with the spacing being determined by such factors as reliable air (combustion medium) injection pressure, the particular combustion supporting medium, the velocity of this medium in the coal bed, the permeability of the coal bed, and the particular type of coal containing the recoverable gaseous products. In the recovery of carbon-containing gases from subterranean coal beds by gasifying the coal, the gaseous products in a forward burn configuration flow through the coal bed to a producer well or are recovered from the same well via a borehole arrangement as is well known in the art where the gaseous products are withdrawn. The control of the combustion zone with respect to its configuration and rate of propagation of the burn front through the subterranean coal bed presents several problems, in that these parameters must be controlled during the combustion process so as to maintain a Btu content of the gas at an acceptable high level. Normally, the forward burn gasification is limited to low coking coal such as lignite and sub-bituminous coal since coals with relatively high coking values release excessive tar vapors which are carried with the gaseous products into cooler regions of the coal bed where the vapors condense and reduce the permeability of the coal bed.

Several efforts have been previously made for increasing the recovery of energy values from coal beds by in situ combustion processes, for example, assignee's U.S. Pat. No. 3,933,447 which issued January 20, 1976 entitled "Underground Gasification of Coal" by Joseph Pasini III, et al. This patent teaches that efficient in situ gasification of subterranean coal beds may be achieved by penetrating the coal bed with spaced-apart directionally drilled boreholes which project along a horizontal plane in the coal bed and extend in a direction normal to the plane of maximum permeability. The combustion of the coal is initiated in one of the horizontal boreholes and products of combustion are recovered from the other borehole which is spaced rom the combustion zone along the plane of maximum permeability. The combustion process described in this patent is enhanced by utilizing the natural fracture system and natural permeability in the coal bed extending between the injection borehole, i.e., the combustion zone, and the producer boreholes, so as to insure the production of product gases and the propagation of the combustion zone therebetween as well as to ensure the removal of product gases. This patent also discloses the use of induced fractures in the coal bed extending between the boreholes to further enhance the removal of the product gases, as well as an increase in the efficiency of the combustion operation.

Other efforts for increasing the concentration of the Btu content of the product gases by in situ combustion of coal are disclosed in assignee's copending U.S. patent application Ser. No. 751,624(70) filed Dec. 17, 1976, now U.S. Pat. No. 4,069,867 and entitled "Cyclic Flow Underground Coal Gasification Process" by Larry A. Bissett, and in Ser. No. 823,480 filed Aug. 10, 1977, now U.S. Pat. No. 4,095,650 and entitled "Method for Increasing the Calorific Value of Gas Produced by the In Situ Combustion of Coal" by Lowell V. Shuck. In the co-pending application Ser. No. 751,624 the product gas is enriched with carbon monoxide and hydrogen by providing a pair of combustion zones in spaced-apart boreholes within a subterranean coal bed and then terminating the combustion in the first of the two zones so that while the exothermic reaction is occurring in the second combustion zone to provide carbon dioxide-laden product gas an endothermic carbon monoxide forming reaction is occurring in the first combustion zone between the carbon dioxide-laden gas perculating thereinto from the second combustion zone and the hot carbon in the walls defining the first combustion zone to increase the concentration of the carbon monoxide and hydrogen in the product gas. When the endothermic reaction in the first combustion zone slows to a selected activity, the roles of the combustion zone are reversed by reestablishing an exothermic combustion reaction in the first combustion zone and terminating the combustion in the second combustion zone. The flow of the gaseous products within the coal bed are reversed to flow in the opposite direction between the combustion zones so that the endothermic reaction occurs in the second combustion zone.

In the copending application Ser. No. 823,480 relatively high Btu gas is produced by penetrating the coal bed with a horizontally extending borehole and then initiating an exothermic combustion reaction in the coal bed contiguous to the borehole. By conveying combustion supporting medium into the combustion zone the absolute pressure within the resulting combustion zone is then regulated at a desired value near the pore pressure within the underground coal bed so that selective quantities of water naturally present in the coal will flow into the combustion zone to effect the hydrogen and carbon monoxide producing steam carbon reaction with the hot carbon defining the combustion zone walls for increasing the calorific value of the product gas.

As pointed out in the aforementioned copending patent applications, the primary concern in a coal gasification operation is the production of a product gas with sufficiently high Btu content to support combustion. Normally, a calorific value of about 80 Btu/scf is required for supporting combustion in an efficient manner. Product gases resulting from a typical gasification operation are normally composed of hydrocarbons, e.g., methane as well as carbon dioxide, carbon monoxide and hydrogen. The carbon dioxide in this mixture does not contribute to the heating value of the product gas and usually comprises about 12 to 18 percent of the gaseous product. The carbon and oxygen of the combustion supporting medium apparently preferentially react to form carbon dioxide rather than carbon monoxide in the combustion zone with carbon monoxide resulting from the combined effects of the steam-carbon reaction ($C + H_2O \rightarrow CO + H_2$) and the water-gas shift reaction ($CO_2 + H_2 \rightarrow H_2O + CO$). Little if any of the carbon monoxide results from the carbon-carbon dioxide reaction ($C + CO_2 \rightarrow 2CO$) apparently due to the absence of a substantive source of hot carbon for the carbon dioxide to react with and the inadequate gas-solid contact times present in conventional underground gasification schemes. Without the occurrence of the carbon-carbon dioxide reaction plus the presence of steam in the combustion zone as provided by the natural water normally in the combustion zone, part of the carbon monoxide that is formed is converted into hydrogen and carbon dioxide so that on a nitrogen free basis, the gaseous product will usually contain substantially more carbon dioxide than carbon monoxide and slightly more hydrogen than carbon monoxide. Further the utilization of the natural water in the coal bed for increasing the concentration of the CO and the $H_2$ in the product gas by the aforementioned reactions has not been efficiently exploited. In previous in situ combustion processes the operating pressures in the combustion zone are maintained considerably higher than the pore pressure in the coal bed so that a substantial quantity of available water in the coal bed was effectively forced away from the combustion zone and thereby eliminated or significantly reduced the valuable and available source of reactant suitable for increasing the Btu content of the product gas.

It is the principal goal or objective of the present invention to convert a substantial portion of the carbon dioxide resulting from the in situ combustion of coal to carbon monoxide and for converting a substantial quantity of the water naturally present in the coal bed to carbon monoxide and hydrogen by utilizing a single combustion zone wherein the natural water in the coal bed and the carbon dioxide in the combustion gases are respectively subjected to a steam-carbon reaction and a carbon-carbon dioxide reaction. These reactions are believed to be capable of adding about 20 to 90 Btu/scf to the heating value of the product gas. The method of the present invention accomplishes this goal by penetrating the coal bed with a suitable borehole and initiating an exothermic reaction in the coal bed contiguous to the borehole to establish a combustion zone therein, introducing combustion supporting medium into the combustion zone for supporting combustion of the coal to support the reaction without exhausting the resulting gaseous products from the combustion zone and coal bed, increasing the pressure of the combustion supporting medium flowing into the combustion zone for maintaining the reaction while forcing the gaseous products together with natural water in the coal bed into the coal bed surrounding the combustion zone, maintaining the flow of the combustion supporting medium into the combustion zone until a predetermined temperature and pressure are attained, terminating the flow of the combustion supporting medium into the combustion zone, and initiating outflow of the gaseous products from the combustion zone for decreasing the pressure therein for causing water and gaseous products forced away from the combustion zone to bleed through the coal bed into the combustion zone where the water and carbon dioxide in the gaseous products react endothermically with the hot carbon defining the walls of the combustion zone to respectively effect the conversion of the water to CO and hydrogen and the carbon dioxide to carbon monoxide. The subject process further contemplates the additional steps of terminating the outflow of the gaseous products from the combustion zone and reintroducing the combustion supporting medium into the combustion zone to reestablish the exothermic reaction for providing the aforementioned predetermined temperature and pressure when the temperature in the combustion zone sufficiently decreases so as to retard the endothermic reaction to a value where the concentration of the carbon monoxide and hydrogen in the gaseous products discharged from the combustion zone drops to a preselected level. As will be described below the temperature and pressure recuperation in the combustion zone may be repetitively utilized.

Other and further objects of the invention will be obvious upon an understanding of the illustrative method about to be described or will be indicated in the appendant claims and various advantages not referred to herein will occur to one skilled in the art upon employment of the invention in practice. The gas compositions and heating values set forth herein are presented on a water-free basis using air as the combustion supporting medium. Different gas compositions and heating values would be derived by using oxygen or oxygen enriched air as a combustion supporting medium.

The preferred embodiments of the invention have been chosen for the purpose of illustration and description of the subject method. The preferred embodiments illustrated are not intended to be exhaustive or to limit the invention to the precise forms disclosed, they are chosen and described in order to best explain the method of the invention and its application and practical use to thereby enable others skilled in the art or best utilize the invention in various modifications of the method as are best adapted to the particular use contemplated.

Figure 2:
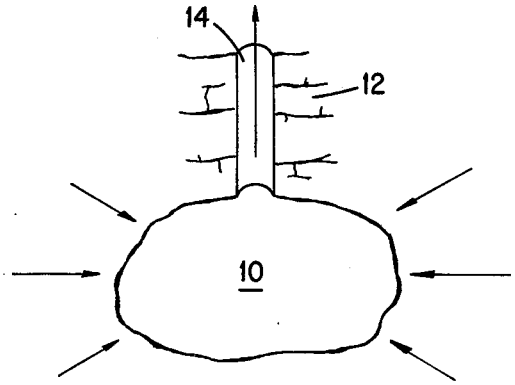
Figure 3:
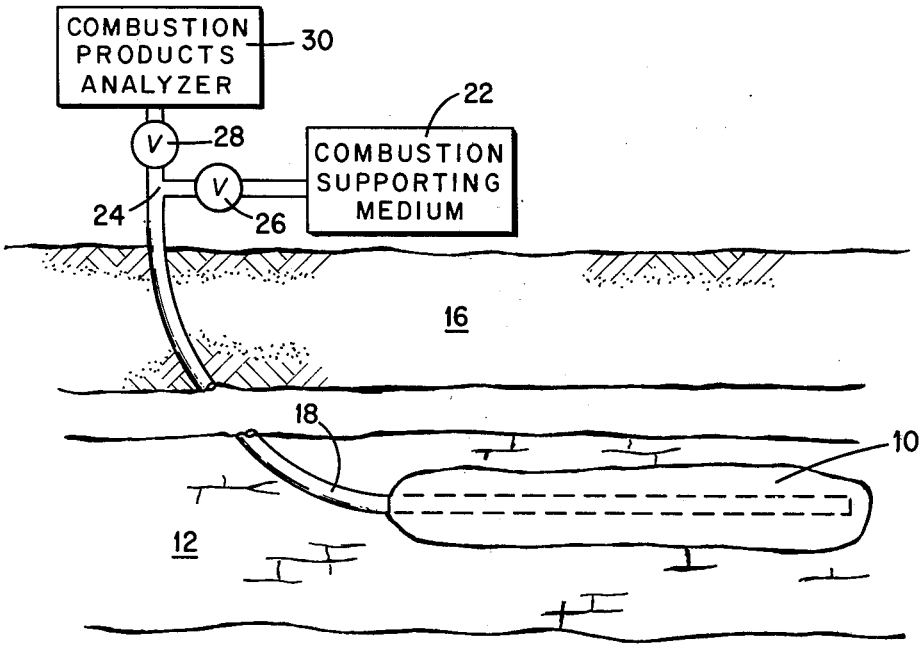
Figure 4:
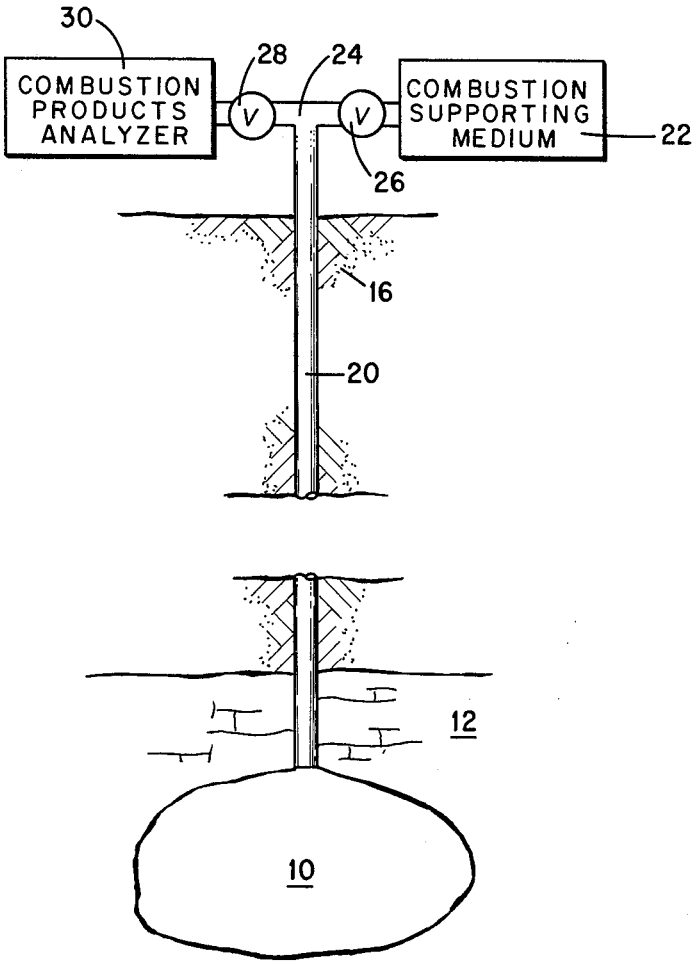

In the accompanying drawings:

FIGS. 1 and 2 are schematic representations of a combustion zone in a subterranean coal bed showing the pressure and temperature cycling utilized in practicing the method of the present invention;

FIG. 3 is a schematic view illustrating a horizontal borehole and combustion zone in the subterranean coal bed wherein the method of the present invention may be practiced; and FIG. 4 is a schematic illustration showing a vertical borehole penetrating a subterranean coal bed for establishing a combustion zone in which pressure-temperature cycling in accordance with the method of the present invention may be practiced.

Described generally and with reference to FIGS. 1 and 2 the present invention is directed to a method for increasing the concentration of hydrogen and carbon monoxide in the product gases resulting from the in situ combustion of coal in a subterranean coal-bearing formation. The concentration of carbon monoxide and hydrogen in the product gas as produced by practicing known in situ gasification techniques is in the range of about 4 to 10 percent and 5 to 15 percent, respectively. By practicing the method of the present invention percentage of the carbon monoxide and hydrogen in the product gases can be respectively increased to about 11 to 29 percent and about 9 to 16 percent. This increase in the concentration of the carbon monoxide and hydrogen by the mechanism described herein increases the heating value of the product gas to about 20 to 90 Btu/scf in the temperature range of 1700° F. to 2000° F.

with the average increase in the heating value being about 59 Btu/scf.

The method of the present invention may be practiced by establishing a combustion zone 10 within a subterranean coal bed 12 by initiating an exothermic combustion reaction within the combustion zone and supporting the reaction by conveying a combustion supporting medium thereinto through a suitable borehole 14 while preventing the outflow or discharge of product gases from the combustion zone and the coal bed. As the combustion proceeds the pressure in the combustion zone forces the product gas (only $CO_2$ is shown but other gases such as $N_2$, CO, $H_2$, and steam are present in the combustion gases etc.) from the combustion zone into the surrounding coal bed via the natural permeability and fracture system present in the coal bed. Also water naturally present in the coal bed is forced away from the combustion zone by the pressure generated therein. The combustion supporting medium is introduced in the combustion zone at increasing pressures to maintain the combustion while forcing the gaseous products and water further into the coal bed. The flow of the combustion supporting medium is maintained until the coal defining the walls of combustion zone is sufficiently hot to support the endothermic reaction necessary to provide the water and $CO_2$ converting reaction and until the pressure within the combustion zone is in the range of about 100 to 200 psi above the pore pressure (pore pressure increase about one psi per foot of depth). When this temperature and pressure are attained the flow of the combustion supporting medium is terminated and the combustion products are allowed to exhaust or be discharged from the combustion zone through the borehole 14. With the discharge of the combustion products the pressure in the combustion zone is allowed to decrease which, in turn, allows the combustion products and water forced into the coal bed to bleed back into the combustion zone where the water and carbon dioxide in the product gases endothermically react with the hot carbon defining the walls of the combustion zone to effect the conversion of the water and carbon dioxide to hydrogen and carbon monoxide.

The exothermic reaction in the combustion zone prior to terminating the flow of the combustion supporting medium thereinto provide the temperature of about 2000° F. which heats the carbon in the walls defining the combustion zone to provide the desired endothermic reaction between the hot carbon and the water and the carbon dioxide in the product gases when the product gases and the water percolate into the combustion zone from the surrounding coal bed. The endothermic reaction for producing the hydrogen and the carbon monoxide continues until the temperature of the hot carbon decreases to about 1700° F. at which temperature the carbon dioxide content of the gaseous product discharging from the combustion zone increases to a predetermined value of about 14 percent. When the temperature reaches or nears this value, the discharge flow of the gaseous product is interrupted and the combustion supporting medium is reintroduced into the combustion zone via the borehole 14 where the combustion supporting medium again exothermically reacts with the coal to heat the coal to the desired temperature of 2000° F. and to again force the product gases and the water back into the coal bed. The exothermic and endothermic reactions as above described are repeatedly cycled until the quality of the product gases reaches a value where the process is no longer efficient or economically practical.

At temperatures above about 2000° F. very little improvement is realized in the quality of the product gases, and such temperatures may cause excessive ash softening or fusing to occur which may significantly impair the permeability of the coal bed. Also at temperatures less than about 1700° F. little advantage is realized in the production of hydrogen and carbon dioxide enriched product gas over conventional in situ combustion processes. Further, the rate of reaction at temperatures less than about 1700° F. is relatively slow so as to inhibit the production of hydrogen and carbon monoxide enriched product gas with practical gas-solid contact times.

As briefly described above, the maximum pressure attainable in the combustion zone and the surrounding coal bed is determined or limited by losses in the coal bed such as gas leakage from the boreholes into the surrounding strata, gas leakage from the reaction zone and coal bed into the surrounding strata, and gas dissipation throughout the coal bed. Also, in order to increase the quantity or volume of gases forced in the coal bed from the combustion zone it may be desirable to induce a fracture from the borehole. The presence of an induced fracture system would greatly increase the volume of gas retainable by the coal bed. Such a fracture may be induced in any well-known manner such as by hydraulic fluids or by the use of a suitable explosive.

The method of the present invention for recovering hydrogen and carbon containing gases from subterranean coal beds by employing in situ gasification procedures may be practiced by employing the drilling schemes such as illustrated in FIGS. 3 and 4. As shown in FIG. 3, a subterranean coal bed 12 is disposed at some level below one or more layers of overburden 16. A directional borehole 18 is drilled from the surface of overburden 16 on a slant so as to penetrate the subterranean coal bed 12 along a substantially horizontally oriented path with respect to the coal bed 12 or with respect to the overburden 16. The borehole 18 may be dirlled either continuously from the surface of the overburden 16 into the coal bed 12 and terminated at some selected location therein as shown, or alternatively, from a surface of the overburden 16 through the selected portion of the coal bed 12 and back to the surface of the overburden 16. The drilling of the borehole 18 within the coal bed 12 may be initiated at any desired vertical angle from the surface of the overburden 16 with this angle dependent upon the depth of the coal bed and the drilling equipment employed. The drilling procedure should be such that when the borehole 18 enters the coal bed 12 it is traveling in a substantially horizontal direction so as to penetrate a desired portion of the coal bed. The use of such a horizontal borehole substantially minimizes a number of boreholes necessary to contact a relatively large segment of the coal bed.

As shown in FIG. 4, a vertical borehole 20 penetrates the overburden 16 and terminates at a suitable location within coal bed 10. This vertical borehole 20 may be provided by employing any well-known commercially available drilling technique.

Upon completion of the aforementioned drilling operations as shown in either FIG. 3 or FIG. 4, the boreholes are preferably cased as commonly practiced to assure registry with the coal bed and minimize losses on the combustion supporting medium and product gases.

Combustion may be initiated in any suitable well-known manner in either the borehole 18 or 20 so as to provide a combustion zone 10 over the length of the borehole 18 within the coal bed and in the coal bed surrounding the terminal end of the borehole 20. In either of the illustrated borehole arrangements combustion supporting medium, e.g. air, is injected into the coal bed 12 from a suitable source such as generally shown at 22 through a conduit system 24 coupled to the boreholes. With the combustion supporting medium flowing into boreholes 18 or 20 the combustion zone 10 burns exothermically to provide a combustion temperature of about 2000° F. while forming a gaseous product which is forced into the coal bed from the combustion zone. In order to control the gasification operation in accordance with the teachings of the present invention, borehole 18 or 20 is provided with flow control valves at the wellhead such as indicated at 26 and 28 in the conduit system 24. The valves 26 and 28 are selectively operated to control the rate of flow of the combustion supporting medium into the combustion zone as well as the extraction of the gaseous product from the latter. The valve 28 at the borehole 18 or 20 is normally closed and the valve 26 is normally open during the exothermic combustion of the operation. After reaching the desired temperature and pressures in the combustion zone valve 26 is closed and the valve 28 is opened to allow the product gas producing endothermic reaction to take place. The control of the combustion supporting medium and the combustion products may be achieved by employing a suitable monitoring system such as generally shown at 30 which may be used to analyze and selectively control the valves to alter, terminate, or initiate the flow of the combustion supporting medium and the combustion products into and from the combustion zone by analyzing the composition of the gaseous products.

It will be seen that the present invention provides a substantial improvement in in situ combustion processes for the recovery of relatively high Btu product gas from subterranean coal beds with the concentration of hydrogen and carbon monoxide in the product gas being at a level substantially higher than practicing conventional in situ combustion processes.

What is claimed is:

1. A method for increasing the concentration of carbon monoxide and hydrogen in the gaseous product resulting from the in situ combustion of coal in a subterranean coal bed, comprising the steps of providing a borehole in the coal bed, initiating an exothermic reaction in the coalbed contiguous to said borehole to establish a combustion zone in the coal bed, introducing combustion supporting medium into said combustion zone to support the reaction without exhausting the resulting gaseous products from the combustion zone and the coal bed, increasing the pressure of the combustion supporting medium flowing into the combustion zone for maintaining the reaction while forcing the gaseous products together with natural water in the coal bed into the coal bed away from the combustion zone, maintaining the flow of the combustion supporting medium into said combustion zone until the predetermined temperature and pressure are attained, terminating the flow of the combustion supporting medium into the combustion zone, and initiating outflow of the gaseous products from the combustion zone for decreasing the pressure therein causing water and gaseous products forced away from the combustion zone to bleed through the coal bed into the combustion zone where the water and carbon dioxide in the gaseous products react endothermically with hot carbon defining the walls of the combustion zone to respectively effect the conversion of the water to carbon monoxide and hydrogen and the carbon dioxide to carbon monoxide.

2. The method claimed in claim 1, including the additional steps of terminating the outflow of the gaseous products from the combustion zone and reintroduting combustion supporting medium into the combustion zone to again establish an exothermic reaction therein for providing said predetermined temperature and pressure when the temperature in the combustion zone sufficiently decreases to retard the endothermic reaction therein to where the concentration of carbon monoxide in the gaseous product discharged from the combustion zone drops to a preselected value.

3. The method claimed in claim 2 wherein said predetermined temperature is 2000° F. and said predetermined pressure is in the range of 100 to 200 psi greater than the pore pressure in the coal bed.

4. The method claimed in claim 2, wherein the outflow of the gaseous products is terminated and the combustion supporting medium is again introduced into the combustion zone when the temperature in the combustion zone decreases to about 1700° F.

5. The method claimed in claim 2 wherein the endothermic and exothermic reactions are reversed when the concentration of carbon monoxide drops to about 11 percent of the gaseous products discharged from the combustion zone.

6. The method claimed in claim 2, wherein the borehole in the coal bed is a horizontal borehole which is drilled at an angle from the surface and penetrates the coal bed along a horizontal plane with respect thereto.

7. The method claimed in claim 2, wherein the borehole is a vertical borehole penetrating and terminating within the coal bed.

* * * * *